US007028811B2

(12) United States Patent
Rauch

(10) Patent No.: US 7,028,811 B2
(45) Date of Patent: Apr. 18, 2006

(54) VEHICLE LIFTING PLATFORM

(75) Inventor: Winfried Rauch, Haldenwang (DE)

(73) Assignee: MAHA Maschinenbau Haldenwang GmbH & Co. KG, (DE)

( * ) Notice: Subject to any disclaimer, the term of this patent is extended or adjusted under 35 U.S.C. 154(b) by 0 days.

(21) Appl. No.: 10/730,802

(22) Filed: Dec. 8, 2003

(65) Prior Publication Data

US 2004/0112682 A1 Jun. 17, 2004

Related U.S. Application Data

(62) Division of application No. 09/942,400, filed on Aug. 29, 2001, now Pat. No. 6,863,159.

(30) Foreign Application Priority Data

Aug. 31, 2000 (DE) ..... 200 15 061 U

(51) Int. Cl.
*B66F 7/02* (2006.01)

(52) U.S. Cl. ..... 187/205; 187/259; 254/294; 254/312

(58) Field of Classification Search ..... 187/203, 187/205, 206, 210, 213, 256, 259, 260, 261, 187/263; 254/311, 294, 312
See application file for complete search history.

(56) References Cited

U.S. PATENT DOCUMENTS

| | | | | |
|---|---|---|---|---|
| 831,518 | A | | 9/1906 | McCarthy |
| 1,118,241 | A | | 11/1914 | Sigafoos |
| 1,477,471 | A | | 12/1923 | Wellman |
| 1,884,447 | A | * | 10/1932 | White ..... 256/1 |
| 2,250,965 | A | * | 7/1941 | Pritz ..... 187/205 |
| 2,349,389 | A | * | 5/1944 | Thompson ..... 187/203 |
| 2,564,267 | A | | 8/1951 | Manke |
| 2,624,546 | A | | 1/1953 | Haumerson |
| 2,661,816 | A | * | 12/1953 | Hulsart ..... 187/210 |
| 4,022,428 | A | | 5/1977 | Mantha |
| 4,300,659 | A | | 11/1981 | Silverstrand |
| 4,763,761 | A | | 8/1988 | McKinsey et al. |
| 5,018,925 | A | * | 5/1991 | Ganser ..... 187/203 |
| 5,207,296 | A | | 5/1993 | Beattie et al. |
| 5,339,925 | A | * | 8/1994 | Price ..... 187/206 |
| 5,497,854 | A | | 3/1996 | Fang |
| 5,501,296 | A | | 3/1996 | Fletcher |
| 6,279,685 | B1 | | 8/2001 | Kogan et al. |

FOREIGN PATENT DOCUMENTS

| | | |
|---|---|---|
| DE | 19 37 870 | 5/1966 |
| DE | 2060935 A | 7/1971 |
| DE | 23 17 695 | 10/1974 |
| DE | 26 43 719 | 4/1977 |
| DE | 81 18 979 | 9/1981 |

(Continued)

*Primary Examiner*—Eileen D. Lillis
*Assistant Examiner*—Thuy V. Tran
(74) *Attorney, Agent, or Firm*—The Maxham Firm

(57) ABSTRACT

A lifting platform for vehicles having at least one column, at least one support arm shiftable on the column by vertical guides and having supports. The lifting platform also includes a prime mover having switching and control elements and a transmission disposed between the prime mover and the associated support arm, the transmission having at least one flexible traction cable coupled to a rotating member positioned at the upper end of the respective column and to the associated support arm.

1 Claim, 2 Drawing Sheets

FOREIGN PATENT DOCUMENTS

| | | |
|---|---|---|
| DE | 195 08 492 | 9/1996 |
| EP | 566 195 | 10/1993 |
| FR | 1 050 578 | 1/1954 |
| FR | 1 051 805 | 1/1954 |
| FR | 1 145 939 | 10/1957 |
| FR | 1393235 | 2/1965 |
| FR | 2 243 143 | 4/1975 |
| WO | 98/15489 | 4/1998 |

* cited by examiner

VEHICLE LIFTING PLATFORM

CROSS-REFERENCE TO RELATED APPLICATION

This application is a divisional of U.S. patent application Ser. No. 09/942,400 filed 29 Aug. 2001 now U.S. Pat. No. 6,863,159.

BACKGROUND

1. Field of the Invention

The invention relates to a lifting platform and more particularly to a vehicle lifting platform having a flexible traction cable coupling an electric motor to support arms.

2. Background Discussion

Conventional lifting platforms for motor vehicles generally function according to the lifting strut principle, the lifting shear principle or the toothed rack or jack screw principle. Even though such lifting platforms fully satisfy the operational and safety technical requirements, the manufacturing costs are substantial, which are caused by the technically complex lifting systems.

Accordingly, there is a need for a vehicle lifting platform with reduced complexity and manufacturing costs. The present invention satisfies these needs and provides related advantages as well.

SUMMARY OF THE INVENTION

It is a primary purpose of the invention to provide a technically simple lifting platform for vehicles which requires little space, can be produced at low cost, can be operated with little maintenance, and at the same time fully satisfies the prevailing safety requirements.

According to the invention these purposes are achieved by providing the transmission of the lifting system with at least one flexible traction cable coupled to a rotating member disposed at the upper end of the column and to the support arm. Suitable traction cables may be steel cables, belts, link chains and the like, all of which are commonly available and can be purchased at low cost in a multitude of embodiments and thicknesses. The same applies to the other components of the lifting system.

To enable the utilization of small-sized electric motors it is efficient to provide a reduction gear between the motor shaft and the rotating member for the traction cable, the reduction gear having simple pairs of gears or a chain drive.

For single-track vehicles, such as motorcycles, motorscooters or the like, the lifting platform according to the invention may have a single column design and, if required, may be provided with a chassis for a mobile application. In this case, it is efficient to arrange the prime mover and the transmission elements in a box-shaped closed container, below or adjacent to the support arm, and to provide an access ramp for moving the vehicle to be lifted in its lifting position on at least one side of the container. For lightweight two-track vehicles, for example, passenger cars, a correspondingly larger dimension single-column lifting platform having the lifting system according to the invention may be used.

A lifting platform according to the invention having a two-column design is characterized in that a separate traction cable is provided for each column, respectively, in which case, when only one single prime mover is used. The torque of the prime mover is uniformly distributed to the driving members of the two traction cables to apply uniform traction forces to the respective support arms and to secure their synchronism. This torque branching is realised in a simple manner by providing a shaft extending between the columns and being driven by a driving member, for example, a sprocket wheel, coupled to the prime mover either directly or via a gear train. To ensure a sufficient free space for the vehicles, the shaft may either be provided on upper extensions of the two columns or at the lower column end, if required on or below the floor level. The same applies to the prime mover which may, together with its gear elements, either be provided at the upper end of a column or at its lower part.

An efficient further development of the invention is characterized in that the prime mover itself or an auxiliary drive may also be operated manually. This allows a lifted vehicle to be lowered manually in case of a defect of the motor-driven lifting system.

According to another embodiment of the invention, brake means are provided for each support arm to be automatically activated to stop the support arms when a critical operating state occurs. An example of this is in case of a breakage of the traction cable or in case of excessive lowering speed.

An additional synchronism control may also be provided which may, for example, effect an emergency stop. The emergency stop may be initiated when the two support arms are moved with different speeds, are positioned at different heights or both.

The so called pulley principle may be applied to the lifting system according to the invention. The traction cable is guided on a relay member provided on the support arm, running on a roller or a sprocket wheel provided at the upper end of the column and being wound up on a driven drum or the like disposed at the lower end of the column. Aside from that the utilization of a closed-loop chain as a traction element is possible.

BRIEF DESCRIPTION OF THE DRAWING

The objects, advantages and features of the invention will be more clearly understood from the following detailed description, when read in conjunction with the accompanying drawing, in which.

DETAILED DESCRIPTION OF THE PREFERRED EMBODIMENTS

Figure 1:
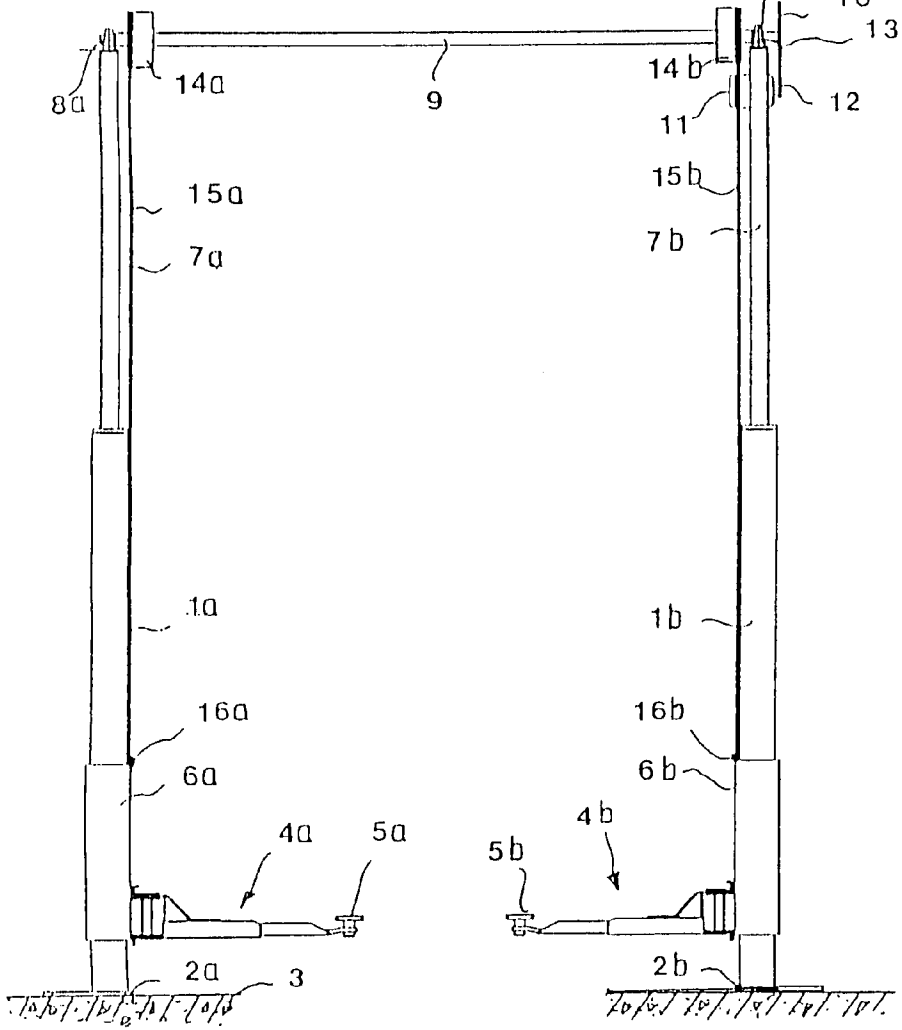
FIG. 1 is a schematic front view of a two-column lifting platform.

The two-column lifting platform according to FIG. 1 is designed for two-track vehicles, particularly passenger cars, and comprises two columns, 1*a* and 1*b*, which are fixedly anchored in floor foundation 3 with associated bases 2*a* and 2*b*. On each of columns 1*a* and 1*b* is a horizontal support arm, 4*a* and 4*b*, respectively, arranged so as to be vertically shiftable. Each of support arms 4*a* and 4*b* is extensible in a telescope-like manner and each is provided with a support 5*a* and 5*b* respectively, at its end. Each of the support arms is attached to a vertical guide, 6*a* and 6*b*, respectively, at its end which at least partly encloses the respective columns 1*a* and 1*b* in the illustrated embodiment. The length of guides 6*a* and 6*b* ensures a tilt-free support of the support arms even with a vehicle driven on, as well as ensuring their free movement.

On each of columns 1*a* and 1*b*, a stable elongation beam 7*a* and 7*b*, respectively, is provided comprising upper bearing 8*a* and 8*b*, respectively, for transverse shaft 9 provided with a sprocket wheel on its right end according to FIG. 1. In the upper end portion of the embodiment in FIG. 1, on right elongation beam 7*b*, a prime mover in the shape of an electric motor 11 is installed which rotates transverse shaft 9 by means of sprocket wheel 12 and a closed-loop chain 13 running on two sprocket wheels 10 and 12. Traction cables 15*a* and 15*b*, which may be steel cables, belts or link chains, run on disks 14*a* and 14*b*, respectively. Traction cables 15*a* and 15*b* are preferably sheathed. Disks 14*a* and 14*b* are fixedly mounted on transverse shaft 9. In the embodiment shown, each of traction cables 15*a* and 15*b* is a steel cable fixed to associated vertical guides 6*a* and 6*b*, respectively, via terminals 16*a* and 16*b* with its one end while its other end portion is fixed on associated disks or drums 14*a* and 14*b*, respectively.

By turning on electric motor 11, transverse shaft 9 is rotated together with the two disks or drums 14*a* and 14*b* by means of chain drive 10 to 13, so that both traction cables 15*a* and 15*b* are wound up with a uniform speed and, thus, two support arms 4*a* are 4*b* are synchronously lifted. The lowering movement of support arms 4*a* and 4*b* is efficiently effected by their own weight or the additional weight of a supported vehicle and also with a speed determined by a brake or electric motor 11.

Figure 2:
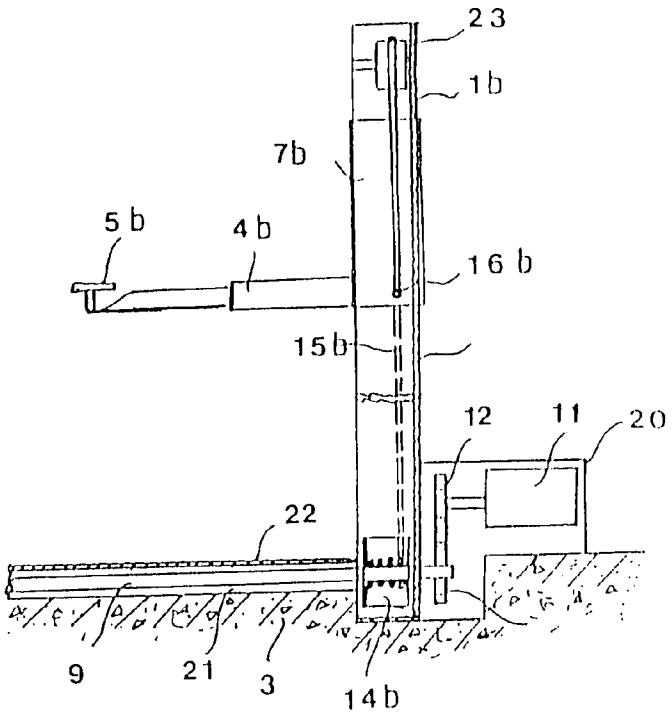
FIG. 2 is a schematic front view of another embodiment of the lifting platform.

In FIG. 2 only the right part of a lifting platform is schematically shown, the second column of said lifting platform including the auxiliary assemblies being formed identically in accordance with the embodiment of FIG. 1. In this embodiment electric motor 11, together with chain drive 10, is disposed in box-shaped housing 20 provided at the lower end of column 1*b* formed as a hollow profile. Correspondingly, transverse shaft 9 extends in groove 21 formed in floor foundation 3 and covered by plate 22. At both end portions of the transverse shaft, drums secured against rotation are provided, only the right side drum 14*b* being shown here. In the present embodiment, as in the embodiment according to FIG. 1, the corresponding portions of the respectively associated torsion cable 15*b* are wound up on drum 14*b*, provided at least partly inside the hollow profile of the column when support arm 4*b* is lifted or lowered. In this embodiment, also steel cable 15*b* running inside the hollow profile is used as the traction cable, the one end of the traction cable being fixed to the lower part of vertical guide 6*b* at 16*b* while the traction cable runs over relay disk 23 turnably supported in the upper end portion of column 1*b*. The cable portion indicated by broken lines is wound up on drum 14*b* provided on the floor side.

Particularly in the embodiment according to FIG. 2, the so-called pulley principle may be applied in a simple way by fixing the one end of traction cable 15*b* in the upper part of column 1*b* and by providing another relay roller in longitudinal guide 6*b*, on which the steel cable then runs to upper relay disk 23.

This embodiment requires increased manufacturing expenses due to groove 21 to be formed in the floor foundation as well as its cover. It is, however, advantageous in that the free space between the two columns is not limited by the transversely extending shaft 9 of the embodiment according to FIG. 1, and in that the columns themselves are not provided with extensions.

Even though two-column lifting platforms are shown in the drawing, each embodiment can also be formed as a single-column lifting platform, in which case transverse shaft 9 is omitted. Particularly, the embodiment according to FIG. 2 is preferably suitable as a single-column lifting platform also applicable for light-weight two track motor vehicles, for example, passenger cars, in which case two support arms 4*b* are provided which can be swung relative to each other at the same height.

The lifting platform according to the embodiments shown in FIGS. 1 and 2 may, in one or other embodiment, also be applied to mobile single-column lifting platforms preferably used for the repair of motorcycles. In such an embodiment, the column may also consist of a plurality of parts that can be shifted into each other in a telescope-like manner, and it may be mounted on a chassis together with the other assemblies.

Figure 3:
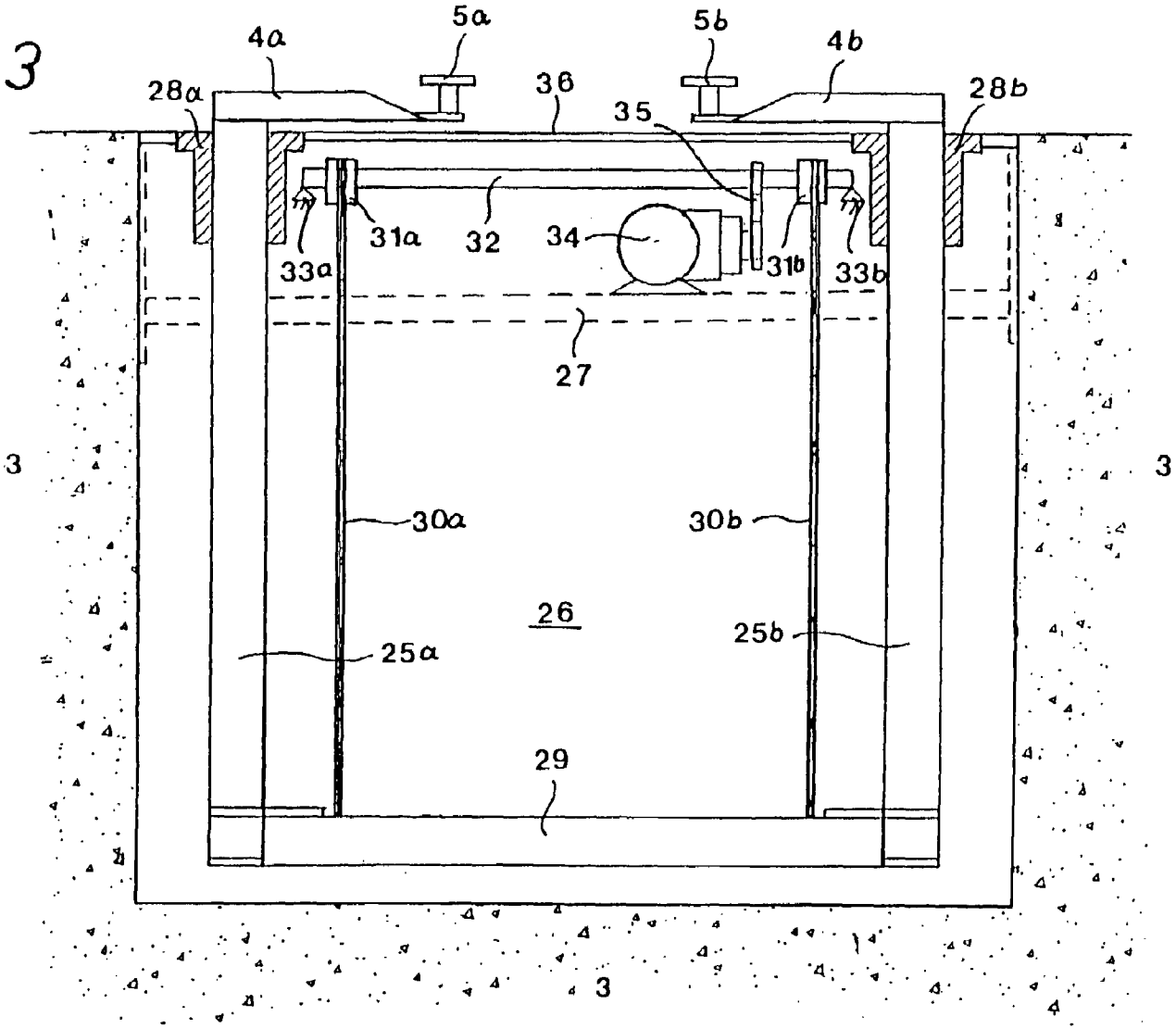
FIG. 3 is a schematic front view of an underfloor lifting platform.

The underfloor lifting platform shown in FIG. 3 comprises two vertical beams, 25*a* and 25*b*, to the upper ends of which horizontal support arms, 4*a* and 4*b*, respectively, each also comprising supports 5*a* and 5*b*, respectively, are adjustable in a telescope-like manner. In the upper part of pit 26 in floor foundation 3, schematically indicated support scaffold 27 is fixed to which guides 28*a* and 28*b*, each for vertical beams 25*a* and 25*b*, are attached. Efficaciously, support scaffold 27 is provided as a pre-assembled constructional unit together with guides 28*a* and 28*b* and the other components so that it may be installed and anchored in pit 26 in a simple manner. The lower ends of two vertical beams 25*a* and 25*b* are fixedly connected to each other by dimensionally stable transverse bar 29 ensuring the synchronism of the vertical beams during their lifting and lowering motions. The lower ends of two traction cables formed as steel cables 30*a* and 30*b* are attached to transverse bar 29, the steel cables extending parallel to the associated vertical beams 25*a* and 25*b*. The upper ends of the steel cables are fixed to drums 31*a* and 31*b*, respectively, both being fixed to common shaft 32. Shaft 32 runs in stationary end side bearings 33*a* and 33*b*, which may be mounted on support scaffold 27. For driving shaft 32, electric motor 34 is provided which is mounted on support scaffold 27, if required together with an integrated gear box, and connected to shaft 32 via chain drive 35. Pit 26 is provided with upper cover 36.

The underfloor lifting platform described above and shown in FIG. 3 may also be provided with only one vertical beam 25 lifted and lowered by only one traction cable 30 formed, for example, as a rope, a chain or a belt. In accordance with the embodiments of FIGS. 1 and 2, the underfloor lifting platform of FIG. 3 may be provided with components effective under safety or operation technical points of view, such as an electronic control with or without position sensors, a cable brake, etc.

Furthermore the embodiments shown may be provided with a manually operable auxiliary drive enabling a slow descent of the vehicle to the foundation floor in case of a defect of the electric prime mover.

What is claimed is:

1. An underfloor lifting platform comprising:

two vertical beams liftable and lowerable in a pit;

at least one support arm comprising supports fixed to said two vertical beams;

a shaft running in two stationary bearings, wherein lower ends of said two vertical beams are fixedly connected to each other by a dimensionally stable transverse beam on which two traction cables engage;

a prime mover comprising switching and control elements; and a transmission between said prime mover and said two vertical beams, wherein said transmission comprises said flexible traction cables, said cables being coupled to a rotating member rotatably driven by said prime mover and said cable engage at a lower end of the associated two vertical beams, wherein said rotating member is a drum for winding and unwinding the associated traction cable, said drum being provided in an upper section of said pit between guides.

* * * * *